US005937827A

United States Patent [19]

Eriksson et al.

[11] Patent Number: 5,937,827

[45] Date of Patent: Aug. 17, 1999

[54] FUEL SUPPLY SYSTEM

[75] Inventors: Dan Eriksson, Huskvarna; Thomas Engman, Mullsjö, both of Sweden

[73] Assignee: Aktiebolaget Electrolux, Stockholm, Sweden

[21] Appl. No.: 08/973,082

[22] PCT Filed: Apr. 12, 1996

[86] PCT No.: PCT/SE96/00482

§ 371 Date: Mar. 2, 1998

§ 102(e) Date: Mar. 2, 1998

[87] PCT Pub. No.: WO96/32584

PCT Pub. Date: Oct. 17, 1996

[30] Foreign Application Priority Data

Apr. 13, 1995 [SE] Sweden ..... 9501387

[51] Int. Cl.[6] ..... F02M 37/04

[52] U.S. Cl. ..... 123/457; 123/511

[58] Field of Search ..... 123/457, 510, 123/511, 514; 220/562, 905

[56] References Cited

U.S. PATENT DOCUMENTS

| | | | |
|---|---|---|---|
| 2,722,208 | 11/1955 | Conroy, Jr. | 123/511 |
| 2,737,167 | 3/1956 | Dickey | 123/511 |
| 2,958,318 | 11/1960 | Ball | 123/511 |
| 3,170,005 | 2/1965 | Phillips . | |
| 3,590,839 | 7/1971 | Moore | 123/511 |
| 4,602,656 | 7/1986 | Nagashima et al. | 137/590 |
| 4,633,843 | 1/1987 | Wissmann et al. | 123/518 |

*Primary Examiner*—Thomas N. Moulis

*Attorney, Agent, or Firm*—Pearne, Gordon, McCoy & Granger LLP

[57] ABSTRACT

Fuel supply system (1) for a combustion engine, which includes a fuel tank (2) suitably supplied with a fuel filter (3) and a duct (4), which connects the fuel tank (2) with a fuel supply unit (5), for instance a carburetor or a fuel injection system. A pressure regulator (6, 7) is, rigidly or flexibly, mounted to one side of the tank (2), suitably the upper side, and is immersed, entirely or mainly, in relation to the tank side, and the pressure regulator is connected somewhere in between the duct's (4) inlet inside the tank (2) and its outlet out of the tank.

9 Claims, 3 Drawing Sheets

FUEL SUPPLY SYSTEM

TECHNICAL FIELD

The subject invention refers to a fuel supply system for a combustion engine, which includes a fuel tank, suitably supplied with a fuel filter and a duct, for instance a fuel hose, which connects the fuel tank with a fuel supply unit, for instance a carburetor or a fuel injection system.

BACKGROUND OF THE INVENTION

Today, many combustion engines, especially smaller engines, have an open or ventilated fuel system. This implies that hydrocarbons evaporate from their fuel tanks and emit air pollution even when the engines are not running, but at the same time overpressure in the fuel tank is prevented, which is very important. In most cases, a handheld working tool, such as a chain saw, has a fuel tank with a ventilation filter, usually made of sintered material. Hereby, the tool can be inclined without any significant fuel leakage, but the other problems, such as smell and air pollution, remain.

Through U.S. Pat. No. 1,633,843 a fuel system is known, which comprises a pressure regulator connected to the fuel tank. The regulator prevents fuel and fuel fumes from leaking out of the fuel tank when it is under overpressure. The regulator is mounted in such a way that it protrudes from the fuel tank and is in its entirety located above the fuel level. Due to this location the regulator is heated up by the heat from the adjacent cylinder and cannot significantly be cooled down by the fuel. This implies an increased risk for vapor bubbles being formed in the fuel and thus causing a so called vapor lock in the regulator.

PURPOSE OF THE INVENTION

The purpose of the subject invention is to substantially reduce the above outlined problems by creating a fuel supply system that prevents or substantially reduces the possibility of any overpressure in the fuel tank propagating to the engine's fuel supply unit, at the same time as heat related problems to a great extent are avoided. Hereby, conditions are created for substantially reducing air pollution and smell caused by evaporation, with maintained satisfactory starting properties and reliability of operation.

SUMMARY OF THE INVENTION

The above purpose is achieved in the device in accordance with the invention having the characteristics appearing from the appended claims.

The fuel supply system in accordance with the invention is thus essentially characterized in that a pressure regulator is mounted, either rigidly or flexibly, to one of the tank's sides, suitably the upper side, and is immersed, either entirely or to a greater part, in relation to the tank side, and the pressure regulator is connected somewhere in between the duct's inlet inside the tank and its outlet out of the tank. The pressure regulator's immersed location reduces its heating and improves its cooling, so that satisfactory starting properties and reliability of operation can be obtained. Hereby, a closed, non-ventilated fuel tank can be used, and air pollution be avoided. Further characteristics and advantages of the invention will be apparent from the ensuing description of preferred embodiments and with the support of the drawing figures.

BRIEF DESCRIPTION OF THE INVENTION

The invention will be described in closer detail in the following by way of various embodiments thereof with reference to the accompanying drawing figures, on which the same numbers in the different figures state each other's corresponding parts.

FIG. 1 shows a fuel supply system in accordance with the invention. The system's fuel tank is integrated with a part of handle system for a chain saw. A pressure regulator is mounted mainly inside the fuel tank.

Figure 1:
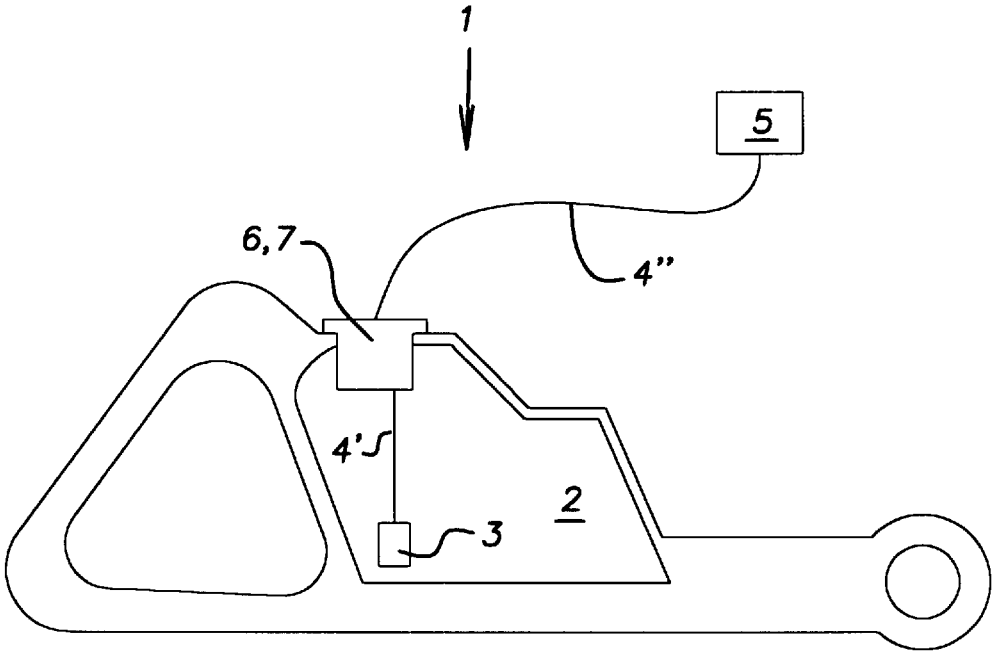

In FIG. 1, numeral reference 1 designates a fuel supply system in accordance with the invention. It includes a fuel tank 2. A pressure regulator 6, 7 is mounted at its upper side, so that it protrudes down into the tank. This positioning is especially favorable in this case, but the regulator can naturally also be placed in other positions. A fuel duct 4, for instance a fuel hose 4, extends from the inside of the fuel tank to a fuel supply unit 5, for example a carburetor or a fuel injection system. In this case the duct consists of a first part 4', which extends from the pressure regulator 6, 7 into the inside of the tank. Its inlet is suitably supplied with a fuel filter 3. In the illustrated case, which refers to a fuel supply system for a chain saw, i.e. a handheld working tool, the tank is turned in all positions during usage of the tool, except for straight upside down. The fuel intake by the fuel filter will hang down in the lower part of the tank or rest against a side wall, when the working tool is inclined. This is an advantage. The first part 4' of the duct 4 can also be designed as a spiral hose, so that the hose's inlet with a possible fuel filter 3 is given an extra large mobility inside the tank. It can thereby rest against the tank's various walls without the hose being so long that it runs the risk of entangling itself. A second part 4" of the duct 4 extends from the pressure regulator 6, 7 to the fuel supply device 5. When overpressure arises in the tank, for instance during a sunny summer's day, an overpressure worth mentioning will not exist in the second part 4" of the duct 4. This is an advantage if the duct should have cracks or similar. Naturally, it is also possible to locate the pressure regulator in direct connection with the fuel supply unit, so that it is integrated with this unit, but then this advantage is not achieved. The first part 4' of the duct 4, which extends inside the tank, is subjected to the same pressure on its inside as well as on its outside.

Figure 2:
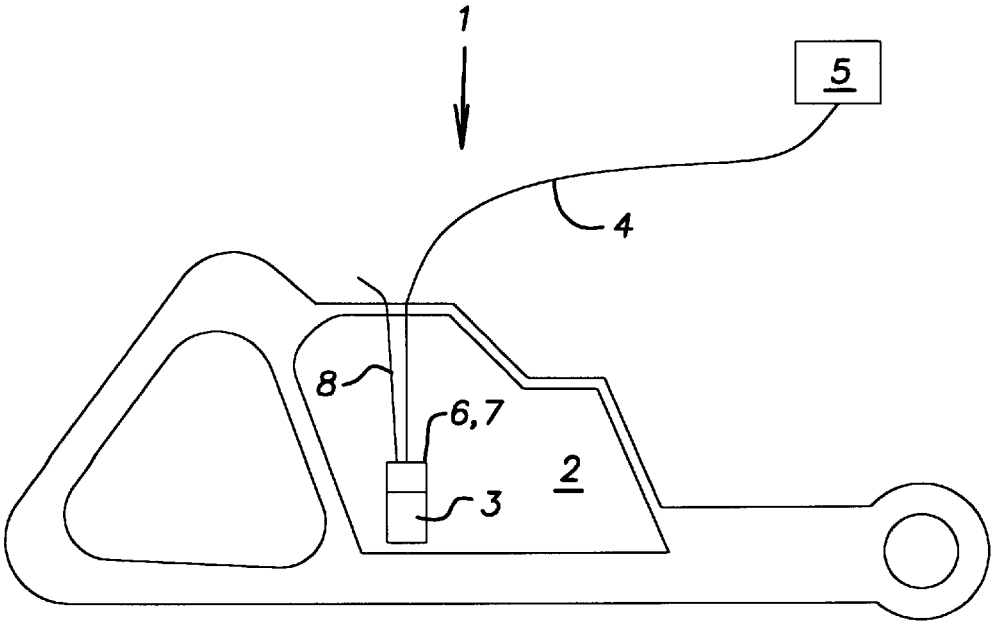
FIG. 2 shows a somewhat different design of the fuel supply system in accordance with the invention. The system's pressure regulator and fuel filter hang down in the tank in a fuel duct and an air duct.

FIG. 2 shows a variant of the fuel supply system in accordance with the invention. In this case the pressure regulator 6, 7 is mounted to the end of a hose 4, which is mounted in the wall of the tank and extends down into the inside of the tank. Suitably a fuel filter 3 is mounted to the pressure regulator and an air hose 8 is arranged from the regulator's air connection and extends out through the wall of the tank. In the illustrated case the hose is mounted in the upper side of the tank, which usually is an advantage. Naturally, it can also be mounted on other sides of the tank. An advantage with this arrangement is that the pressure regulator's weight helps to bring down the fuel inlet to the deepest part of the tank. This is important, especially for a handheld working tool, which is used a lot. The two hoses 4 and 8 are suitably connected and designed as a so called spiral hose. It usually looks like an ordinary telephone wire.

Hereby, the fuel inlet is given an extra large mobility inside the tank, so that the inlet easily reaches the tank's deepest part, without an unnecessarily long hose having to be used. This could otherwise increase the risk of the hose entangling itself.

Figure 3:
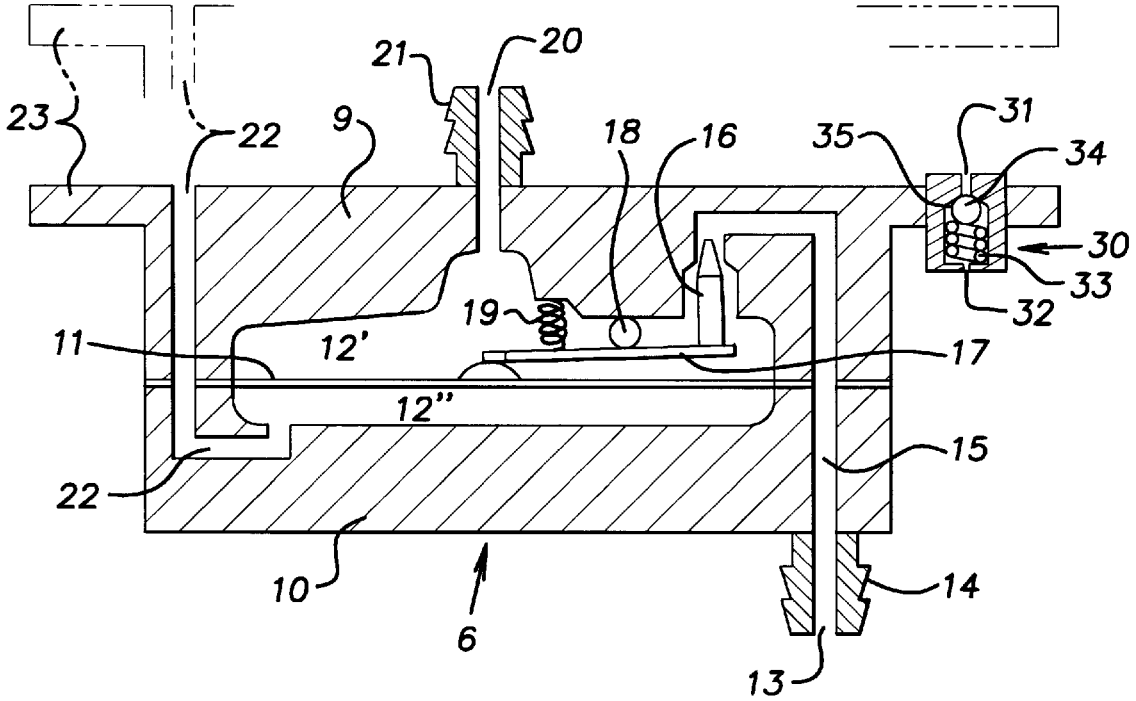
FIG. 3 shows a first embodiment of a pressure regulator, which is a part of the fuel supply system.

FIG. 3 shows a pressure regulator 6, which is especially suited to be used in combination with a fuel supply unit 5, which takes up fuel on its own, for instance a carburetor with a built-in pump. The regulator consists of an upper housing part 9 and a lower housing part 10. A diaphragm 11 is squeezed between the housing parts, air and liquid tight. The diaphragm 11 divides a cavity 12 inside the regulator into an upper part 12' and a lower part". The upper cavity part 12' is connected with a fuel inlet 13, which in this case is supplied with a fuel nipple 14 so that a fuel hose can be connected—in the embodiment in accordance with FIG. 1, hose 4'. On the contrary, in the embodiment in accordance with FIG. 2 a hose is not required, since the fuel inlet in this case exits directly in the fuel filter 3 inside the tank.

A fuel duct 15 extends to the upper cavity pat 12'. A valve body 16 is arranged at the mouth. The valve body is in its opposite end mounted to one of the ends of a lever 17, whose other end is mounted to the diaphragm 11. The lever 17 turns around a pivot 18 and a spring 19 loads the lever 17, so that the valve body 16 closes the fuel duct 15, at least when there is no suction effect at the fuel outlet 20. A fuel nipple 21 is arranged at the fuel outlet in order to connect a fuel hose, hose 4" in FIG. 1 and hose 4 in FIG. 2. The lower cavity part 12" is supplied with an air duct 22. This exits on the upper side of the regulator body, which is suitable in the embodiments in accordance with FIGS. 1 and 2. The mouth can be supplied with a hose nipple, or a dirt cover. A mounting flange 23 extends around the upper housing part 9 and enables the pressure regulator to be fitted immersed in the tank 2. The tank 2 then has an opening or a hole in one side, which is big enough to bring the pressure regulator into the hole and for it to rest against flange 23, suitably with a scaling between the tank and the flange. One advantage with this design is that the regulator protrudes only marginally and is well protected inside the tank, at the same time as it easily can be replaced. However, the regulator can naturally also be fitted entirely on the inside of the tank. Two different alternative designs are shown with dash dotted lines. A higher located flange 23 can be seen at the top of the figure. When using this design, the air duct 22 as well as the fuel duct including outlet 20 are extended, so that they reach the upper side of the regulator. Hereby the regulator is immersed deeper into the fuel and even the greater part of its upper side can be covered by fuel, so that the important cooling effect is enhanced. In the figure's bottom right part an example is shown of a more deeply located and side shifted fuel inlet 13. It is an advantage if the fuel nipple 14 is located at approximately the same distance from the tank's corners, especially the lower ones. Owing to the immersion in the tank, the regulator is cooled effectively at the same time as it takes up little heat from the cylinder, and this can easily be enhanced by means of insulating material along its upper side.

A check valve 30 is firmly mounted in the flange 23. This is also applies to the alternative dash dotted solution, but is not shown there. It has an air inlet 31 and an outlet 32. A spring 33 presses a ball 34 against a tapered valve seat 35. Fumes and fuel cannot pass from the outlet 32 to the inlet 31. On the other hand, air can pass the opposite way and prevent underpressure from arising in the fuel tank.

The air duct 22 brings in atmospheric pressure to the underside of the diaphragm 11. The compression spring 19 is tuned so that the valve body 16 keeps the fuel duct 15 closed up to approximately 200 kPa pressure in the fuel duct 15, assuming that no underpressure exists at the fuel outlet 20. Hereby, the valve is kept completely closed even if overpressure is formed inside the tank, for instance, if the tank 2 is exposed to intense sunlight. This is a great advantage. As soon as the engine starts its fuel pump creates a suction, which opens the valve by means of the valve body 16 being moved downwards. Already an underpressure of 2 kPa opens the valve. The mentioned pressure values are normal and are changed by altered relation between the diaphragm and the valve area, altered leverage and altered spring force.

Figure 4:
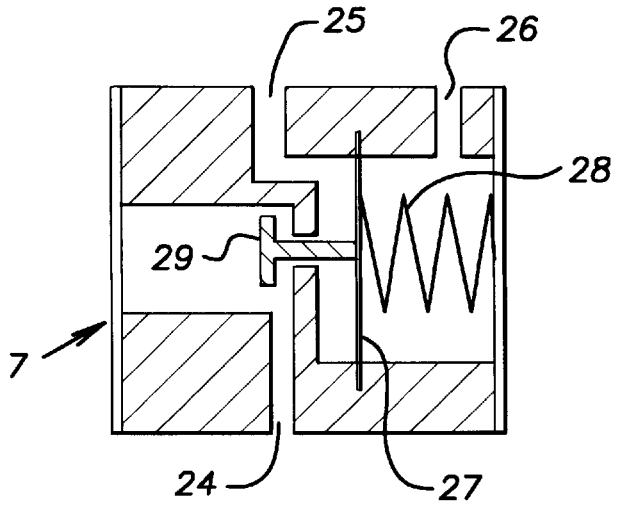
FIG. 4 shows a second embodiment of a pressure regulator, which is a part of the fuel supply system.

In FIG. 4 a somewhat different pressure regulator is shown. On the whole it functions as the previous one and it has a fuel inlet 24, a fuel outlet 25 and an air inlet 26. Furthermore, it has a diaphragm 27, a regulating spring 28 and a valve body 29. The valve body never closes the passage entirely between fuel inlet 24 and fuel outlet 25. Instead the pressure at the fuel outlet is substantially reduced, usually to approximately 2 kPa. Thus, an overpressure in the fuel tank is substantially but not entirely reduced in the pressure regulator 7. This is advantageous for some types of fuel supply units, for instance a float carburetor which lacks a fuel pump. Thereby a certain fuel leakage can however still occur.

A diaphragm carburetor has a valve mechanism similar to the one in the pressure regulator 6. However, when the carburetor becomes worn this valve often leaks, which in combination with a closed fuel tank could lead to that the engine is flooded with fuel and fuel leakage occurs. A separate pressure regulator 6 can be optimized, especially as regards an assured valve closure and is suitably located so that the fuel hose 4, 4" is not put under pressure, with consequent risk for fuel leakage.

Figure 5:
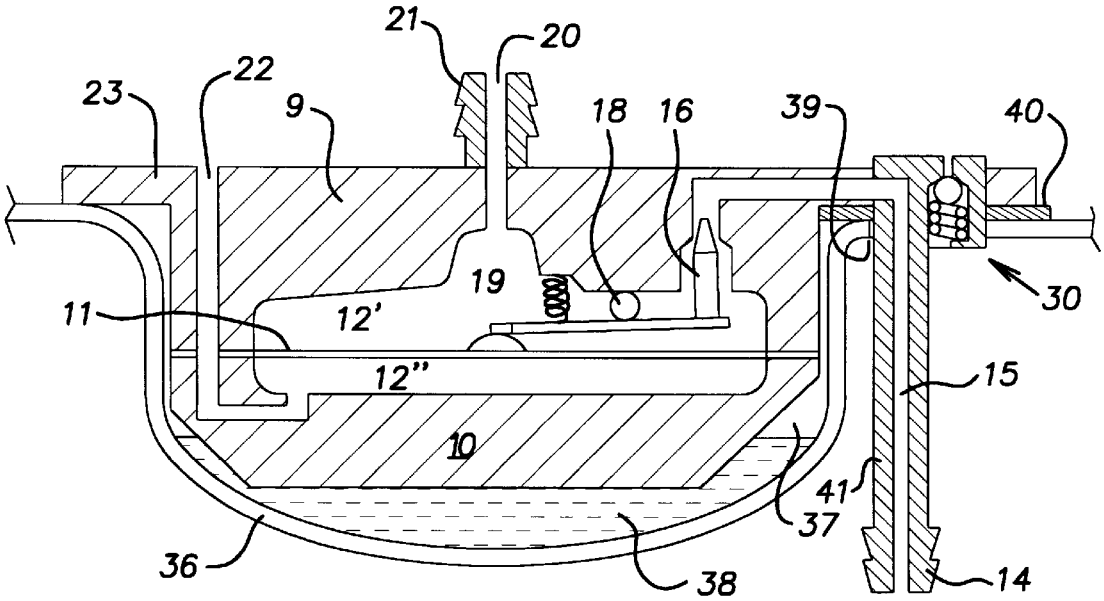
FIG. 5 shows a pressure regulator similar to the one in FIG. 3, but immersed in a cavity in the fuel tank.

FIG. 5 shows a fuel supply system with a pressure regulator 6, 7 to a greater part immersed in a cavity 37 embodied in the tank. A heat conducting composition 38 fills, entirely or partly, the space between the tank wall 36 in the cavity and the pressure regulator, so that a satisfactory cooling can be obtained. With a drawn up flange, as the dash dotted in FIG. 3, and a deeper cavity the pressure regulator can be immersed deeper into the tank. It can then also be partly covered by a heat conducting composition. The fuel duct 15 has been drawn somewhat differently than in the regulator in FIG. 3. It extends out into a flange part 23 and from there it is drawn into the tank. This occurs by means of a tube section 41, which extends into the tank. In this case it is integrated with the check valve 30, but it does not have to be. A seal 40 seals between the flange part 23 and the tank wall 36 around the opening 39, where the tube section 41 and the check valve 30 extend through the tank wall. The opening 39, which must be sealed, becomes small in this case. Suitably the pressure regulator, in the various preferred embodiments with fixed mounting to the tank, is fastened with for instance screws.

It is also possible to arrange a fuel system with a pressurized fuel tank. The pressure can be arranged by means of a duct from the crank ease or the combustion chamber. At least one check valve is arranged in the pressurization system, since the pressure sources show overpressure as well as underpressure. In this case a pressure regulator 7 is suitably used, which lets out fuel with a well balanced low pressure to the fuel supply unit 5. Hereby this need not have a fuel pump of its own.

We claim:

1. Fuel supply system (1) for a combustion engine, comprising a fuel tank (2) suitably supplied with a fuel filter (3) and a duct (4) connecting the fuel tank (2) with a fuel supply unit (5), wherein a pressure regulator (6, 7) is rigidly secured to one side of the tank (2), a major portion of said pressure regulator being disposed within said tank and relatively beneath said one side, said pressure regulator being disposed between an inlet of the duct, which is disposed within the tank, and an outlet of the duct (4).

2. Fuel supply system (1) in accordance with claim 1, wherein the tank defines an opening and the major portion of the pressure regulator (6, 7) extends through said tank opening, said pressure regulator being firmly mounted to said one side of the tank adjacent said opening.

3. Fuel supply system (1) for a combustion engine, comprising a fuel tank (2) suitably supplied with a fuel filter (3) and a duct (4) connecting the fuel tank (2) with a fuel supply unit (5), wherein one side of said tank (2) defines a cavity (37) and a pressure regulator (6, 7) is rigidly secured to said one side of the tank (2) such that a major portion of the pressure regulator is received in said cavity (37), said pressure regulator being disposed between an inlet of the duct, which is disposed within the tank, and an outlet of the duct (4).

4. Fuel supply system (1) in accordance with claim 1, wherein a first part (4') of the duct (4), which extends from the inlet to the pressure regulator and is disposed within said tank, is a spiral hose, so that the inlet to the duct has a large range of motion inside the tank.

5. Fuel supply system (1) for a combustion engine, comprising a fuel tank (2), a fuel filter (3), a fuel hose (4), a pressure regulator (6, 7), and an air hose (8), wherein the pressure regulator (6,7) is secured to an end of the fuel hose (4), said fuel hose is mounted to a wall of the tank and extends down into the inside of the tank such that said end and said pressure regulator are entirely received within said tank, said fuel filter (3) is mounted to the pressure regulator (6,7), and said air hose (8) extends from an air connection of the pressure regulator and through the tank wall.

6. Fuel supply system (1) in accordance with claim 5, wherein the fuel hose and the air hose (4, 8) are spiral hoses, so that the pressure regulator has a large range of motion inside the tank.

7. Fuel supply system (1) in accordance with claim 3, wherein a wall (36) of said tank defines said cavity (37) and a heat conducting composition (38) at least partially fills a space in the cavity (37) between the tank wall (36) and the pressure regulator.

8. Fuel supply system (1) in accordance with claim 2, wherein a first part (4') of the duct (4) is a spiral hose, so that the inlet to the duct has a large range of motion inside the tank.

9. Fuel supply system (1) in accordance with claim 3, wherein a first part (4') of the duct (4) is a spiral hose, so that the inlet to the duct has a large range of motion inside the tank.

* * * * *

UNITED STATES PATENT AND TRADEMARK OFFICE

CERTIFICATE OF CORRECTION

PATENT NO. : 5,937,827

DATED : August 17, 1999

INVENTOR(S) : Eriksson et al.

It is certified that error appears in the above-identified patent and that said Letters Patent is hereby corrected as shown below:

Column 3, Line 13, delete "part"", and insert --part 12"--.

Signed and Sealed this

Twenty-second Day of February, 2000

*Attest:*

Q. TODD DICKINSON

*Attesting Officer*

*Commissioner of Patents and Trademarks*